US009623341B1

(12) United States Patent
Mamelka

(10) Patent No.: US 9,623,341 B1
(45) Date of Patent: Apr. 18, 2017

(54) WATER TEETER TOTTER SYSTEMS

(71) Applicant: John Mamelka, San Francisco, CA (US)

(72) Inventor: John Mamelka, San Francisco, CA (US)

( * ) Notice: Subject to any disclaimer, the term of this patent is extended or adjusted under 35 U.S.C. 154(b) by 0 days.

(21) Appl. No.: 14/967,362

(22) Filed: Dec. 14, 2015

(51) Int. Cl.
*A63G 11/00* (2006.01)
*A63G 31/00* (2006.01)
*A63H 27/10* (2006.01)

(52) U.S. Cl.
CPC ..... *A63G 31/007* (2013.01); *A63G 11/00* (2013.01); *A63H 27/10* (2013.01); *A63H 2027/1008* (2013.01); *A63H 2027/1033* (2013.01)

(58) Field of Classification Search
CPC ..... A63G 31/007
See application file for complete search history.

(56) References Cited

U.S. PATENT DOCUMENTS 3,231,269 A * 1/1966 Dalrymple, Jr. ..... A63G 11/00 472/106
3,539,181 A 11/1970 Waukesha et al.
6,454,658 B1 9/2002 Drouin

* cited by examiner

*Primary Examiner* — Michael Dennis

(57) ABSTRACT

A water teeter-totter system is a teeter totter that uses the inertia developed while in use to operate water pumps to pump water through a plurality of spray nozzles to combine water amusement with the fun of gliding on the device. The downward motion of each side of the teeter totter actuates a different pump to spray water alternately at one user and then at the other user. A centrally located tube is able to be coupled to various ornamentally designed appurtenances that perform an action from spraying water through the appurtenance to blowing up balloons.

19 Claims, 5 Drawing Sheets

WATER TEETER TOTTER SYSTEMS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of teeter totters and more specifically relates to a water teeter-totter system.

2. Description of the Related Art

A seesaw (also known as a teeter-totter or teeter board) is a long, narrow lever pivoted in the middle on a fulcrum so that, as one end goes up, the other goes down. The most common design of a playground teeter totter features a board balanced in the center. A person sits on each end, and they take turns pushing their feet against the ground to lift their side into the air. Playground seesaws usually have handles for the riders to grip as they sit facing each other. Seesaws or teeter totters are generally of simple design having just a lever with seats at opposite ends and a fulcrum. The balance of the lever when two people of similar weight are sitting on each end allows almost an effortless push off of the ground to become airborne for a disproportionate amount of time. For instance, a one half second push might result in being airborne for 3 or 4 seconds. The ease of becoming airborne on this playground equipment makes it a favorite of children of various ages. One aspect of the teeter totter is the amount of inertia developed with almost effortless force. Teeter totters have remained virtually unchanged since the idea was conceived, but by capturing the inertia and using it to add a novel secondary entertainment system would certainly add to the enjoyment and the novelty of the apparatus.

Various attempts have been made to solve the above-mentioned problems such as those found in U.S. Pat. No. 6,454,658 to Michael A. Drouin; U.S. Pat. No. 3,231,269 to Roy F. Dalrymple et al; and U.S. Pat. No. 3,539,181 to Norbert M. Larsen Waukesha et al. This art is representative of teeter-totters. None of the above inventions and patents, taken either singly or in combination, is seen to describe the invention as claimed.

Ideally, a water spraying teeter totter should provide a child-themed functional ornate design with alternating direction sprays, and, yet, would operate reliably and be manufactured at a modest expense. Thus, a need exists for a reliable water teeter-totter system to avoid the above-mentioned problems.

BRIEF SUMMARY OF THE INVENTION

In view of the foregoing disadvantages inherent in the known teeter totter art, the present invention provides a novel water teeter-totter system. The general purpose of the present invention, which will be described subsequently in greater detail, is to provide a teeter totter having a child themed ornate design with alternating water sprays.

The water teeter-totter system preferably comprises a teeter-totter assembly having a lever with a first end having a plurality of first spray nozzles, a first seat and a first handle, a second end having a plurality of second spray nozzles, a second seat and a second handle, a balance point, a base comprising a top end and a bottom end, a through-hole having a fulcrum located centrally in the bottom of the through-hole, a water reservoir, a first piston water pump and a second piston water pump, a plurality of water tubes, and at least one accessory water spout.

The water teeter-totter system is an apparatus that is designed for entertaining children with a teeter totter assembly that has water spray nozzles of various novel designs positioned in various locations on the teeter totter. In greater detail, the first end of the lever is at an opposing end of the lever from the second end. The first seat is attached to the first end of the lever and the second seat is attached to the second end of the lever. The first handle is rigidly attached to the top side of the lever near the first seat and the second handle is rigidly attached to a top side of the lever near the second seat. The balance point is located on the bottom side of the lever midway between the first end and the second end.

The plurality of first spray nozzles is located linearly along the top side of the lever toward the first end of the lever from the balance point. The plurality of second spray nozzles is located linearly along the top side of the lever toward the second end of the lever from the balance point. The first spray nozzles are arranged to spray toward the first seat and the second spray nozzles are arranged to spray toward the second seat. The first spray nozzles are operatively attached to the first piston water pump via a plurality of water tubes so that when the first piston water pump is activated, water is sprayed out (misted out/atomized or other) of the first spray nozzles. The second spray nozzles are operatively attached to the second piston water pump via a plurality of water tubes so that when the second piston water pump is activated, water is sprayed out of the second spray nozzles.

The base preferably comprises a top end located vertically and concentrically above the bottom end with the bottom end larger in diameter than the top end. The water reservoir is located within the bottom end of the base. The reservoir may comprise an inverted frustoconical profile having a larger diameter bottom end than top end that is designed for setting on a ground surface. The base may have a greater stability when the reservoir is filled with water due to the added weight but numerous other options exist for stabilizing the base if needed.

The first piston water pump and the second piston water pump are located within the water reservoir. The reservoir may comprise a hose connection so that it is able to be coupled to a garden hose to be filled, and may have a float-valve so that when a predetermined high water level within the reservoir is reached, the float-valve is able to shut off the water to prevent overfilling. The first piston water pump and the second piston water pump may each comprise an intake check valve that allows water to enter the pumps through the first and the second intakes respectively and prevents the water from exiting again through the intakes.

A relatively large through-hole is located near the top end of the base with the fulcrum located within the through-hole such that the lever is able to be positioned through the through-hole and pivotally positioned upon the fulcrum. The lever is operatively attached to the first piston water pump and the second piston water pump. A downward rotation of the first end of the lever activates the first piston water pump and is able to cause water to spray through the first spray nozzles. A downward rotation of the second end of the lever activates the second piston water pump and is able to cause water to spray through the second spray nozzles. The first piston shaft of the first piston water pump is attached to a first piston pivot-bracket that is non-removably attached to the bottom side of the lever slightly toward the first end of the lever from the fulcrum. The second piston shaft of the second piston water pump is attached to a second piston pivot-bracket that is non-removably attached to the bottom side of the lever slightly toward the second end of the lever from the fulcrum.

An accessory water spout is located on the upper periphery of the top end of the base and is in operative communication with the first and second piston water pumps via the plurality of water tubes. The first piston water pump is able to couple to a first and a second water tube. The first water tube is coupleable to the first water spray nozzles and the second water tube is coupleable to the accessory water spout. At least one appurtenance is coupleable to the accessory water spout such that the appurtenance is able to spray water via the first piston water pump and the second piston water pump. The appurtenance may have the appearance of a simulated clown head, a dolphin head, or a balloon holder that may be able to couple to more than one balloon simultaneously. The first piston water pump and the second piston water pump are each able to pump air instead of water through the accessory water spout to fill at least one balloon via the balloon holder if the user desires.

The teeter-totter assembly is an apparatus that is useful for providing long term entertainment for children that combines an ornately designed teeter totter with a water spray system. By filling the water reservoir of the base with water and causing a continuous up and down pivoting motion of the lever via a first user sitting on the first seat and a second user sitting on the second seat, the first piston water pump and the second piston water pump are activated to pump water through the first and second spray nozzles to spray the first user and the second user for amusement.

The water teeter-totter system may comprise a kit that includes at least one teeter-totter assembly with at least one lever having a plurality of first spray nozzles, a plurality of second spray nozzles, a first seat, a second seat, a first handle, a second handle, at least one base having at least one first piston water pump and the at least one second piston water pump, a plurality of water tubes, at least one accessory water spout, at least one appurtenance, and at least one set of user instructions.

A method of using the water teeter-totter system may comprise the steps of: coupling a garden hose to the hose connection on the reservoir of the teeter-totter assembly; opening the hose bib to fill the reservoir; sitting on the first seat and the second seat simultaneously by a first and a second user; pivotally-rotating the lever so that the first and the second seat rises and falls oppositely from each other causing water to spray alternately toward the first seat and the second seat; and then closing the hose bib and disconnecting the water.

The present invention holds significant improvements and serves as a water teeter-totter system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, water teeter-totter system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a teeter totter and more particularly to a water teeter-totter system as used to combine children's themes with a water spraying recreational device.

Generally speaking, a water teeter-totter system is a teeter totter that uses the inertia developed while in use to operate water pumps to pump water through a plurality of spray nozzles to combine water amusement with the fun of gliding on the device. The downward motion of each side of the teeter totter actuates a different pump to spray water alternately at one user and then at the other user. A centrally located tube on the top of the base is able to be coupled to various ornamentally designed appurtenances that perform action from spraying water through the appurtenance to blowing up balloons.

Figure 1:
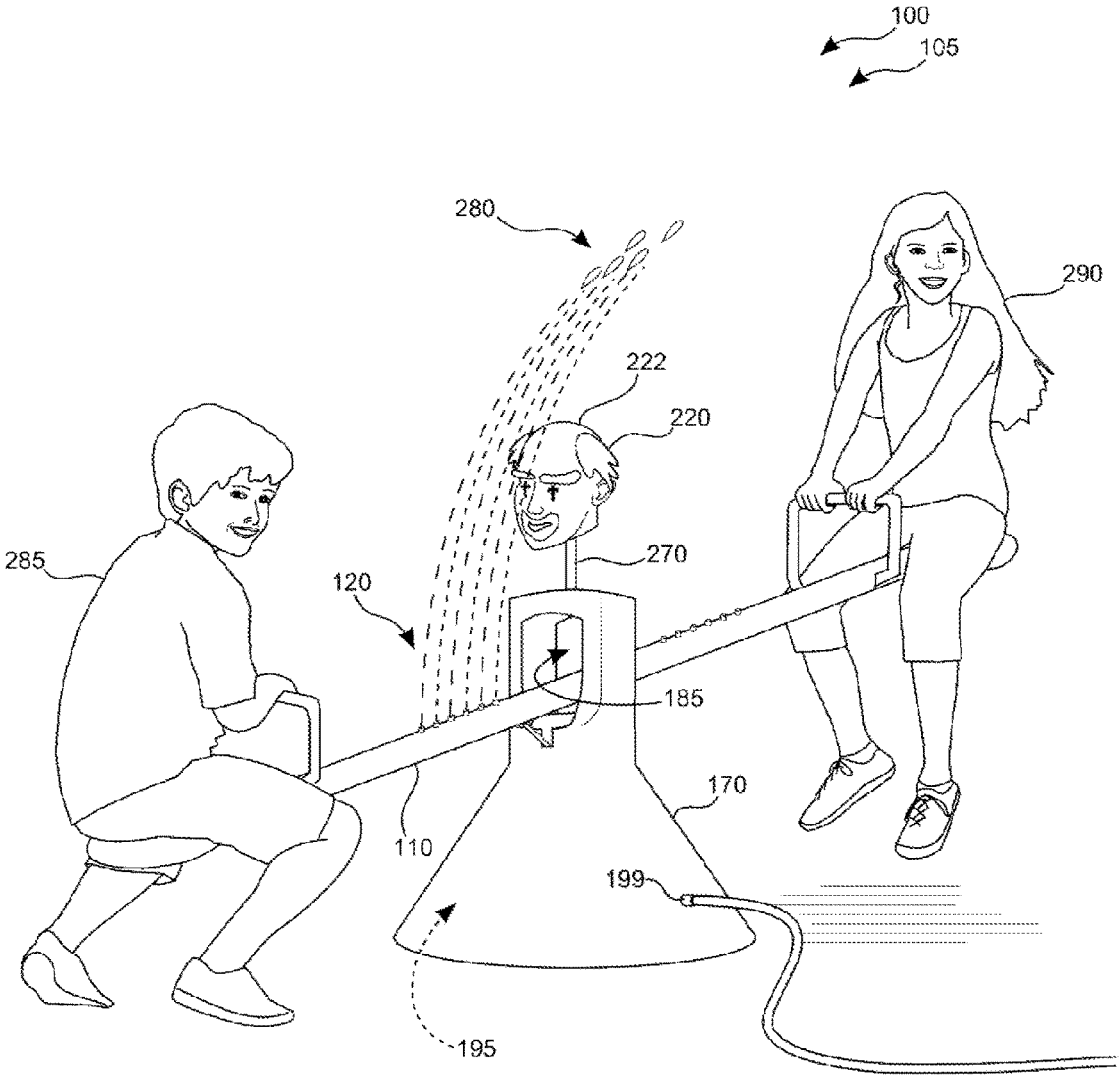
FIG. 1 shows a perspective view illustrating an in-use condition of a water teeter-totter system according to an embodiment of the present invention.

Referring to the drawings by numerals of reference there is shown in FIG. 1, a perspective view illustrating an in-use condition of water teeter-totter system 100 according to an embodiment of the present invention.

Water teeter-totter system 100 is an apparatus that is designed for entertaining children with teeter-totter assembly 105 that has water spray nozzles 275 of various novel designs positioned in various locations on teeter-totter assembly 105. Teeter-totter assembly 105 is an apparatus that is useful for providing long term entertainment for children that combines an ornately designed teeter-totter assembly 105 with a water spray system. By filling water reservoir 195 of base 170 with water 280 and causing a continuous up and down pivoting motion of lever 110 via first user 285 sitting on first seat 125 and second user 290 sitting on second seat 145, first piston water pump 200 and second piston water pump 235 are activated to pump water 280 through first 120 and second spray nozzles 140 to spray first user 285 and second user 290 for amusement.

Figure 2:
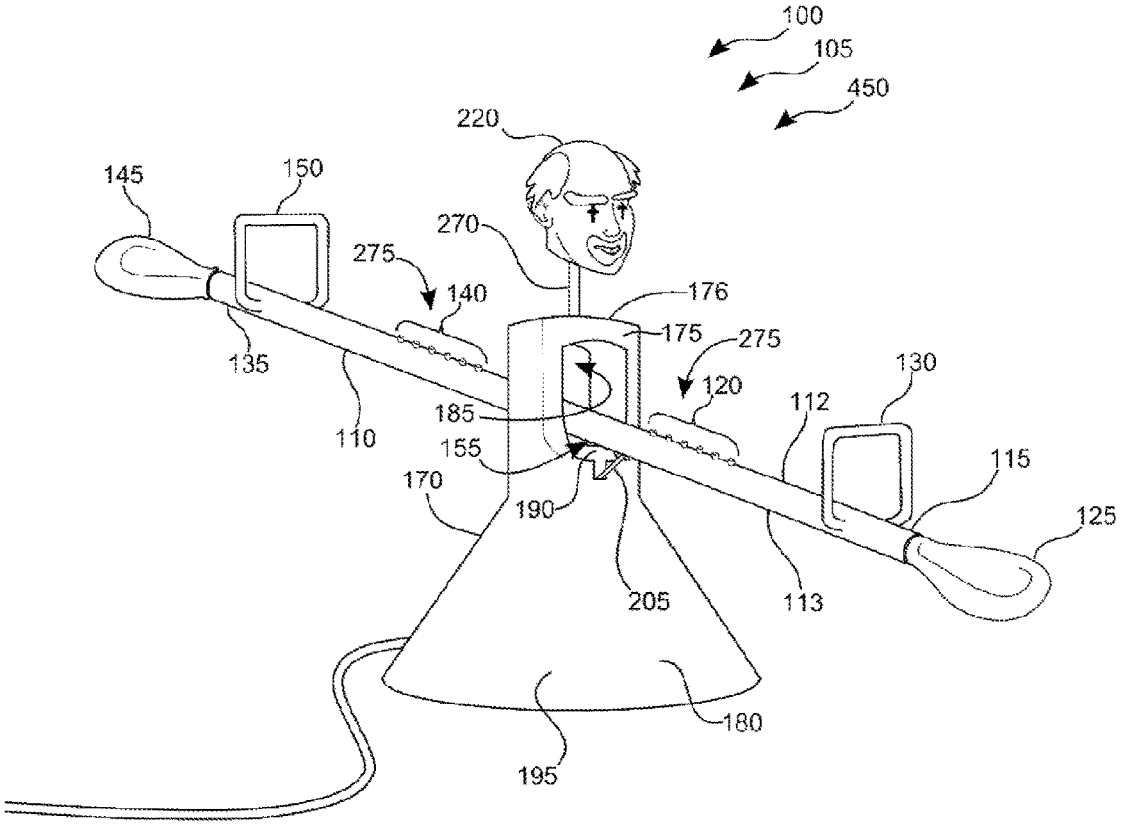
FIG. 2 is a perspective view illustrating the water teeter-totter system according to an embodiment of the present invention of FIG. 1.

Referring now to FIG. 2, a perspective view illustrating water teeter-totter system 100 according to an embodiment of the present invention of FIG. 1.

Water teeter-totter system 100 preferably comprises teeter-totter assembly 105 having lever 110 with first end 115 having a plurality of first spray nozzles 120, first seat 125 and first handle 130, second end 135 having a plurality of second spray nozzles 140, second seat 145 and second handle 150, balance point 155, base 170 comprising top end 175 and bottom end 180, through-hole 185 having fulcrum 190 located centrally in the bottom of through-hole 185, water reservoir 195, first piston water pump 200 and second piston water pump 235, a plurality of water tubes 160, and at least one accessory water spout 270. First end 115 of lever 110 is at an opposing end of lever 110 from second end 135. First seat 125 is attached to first end 115 of lever 110 and second seat 145 is attached to second end 135 of lever 110. First handle 130 is rigidly attached to top side 112 of lever 110 near first seat 125 and second handle 150 is rigidly attached to top side 112 of lever 110 near second seat 145. Balance point 155 is located on bottom side 113 of lever 110 midway between first end 115 and second end 135.

Base 170 preferably comprises top end 175 located vertically and concentrically above bottom end 180 with bottom end 180 larger in diameter than top end 175. Water reservoir 195 is located within bottom end 180 of base 170. Water reservoir 195 may comprise an inverted frustoconical profile having a larger diameter bottom end 180 than top end 175 that is designed for setting on a ground surface. Base 170 may have a greater stability when water reservoir 195 is filled with water 280 due to the added weight but numerous other options exist for stabilizing base 170.

Figure 3:
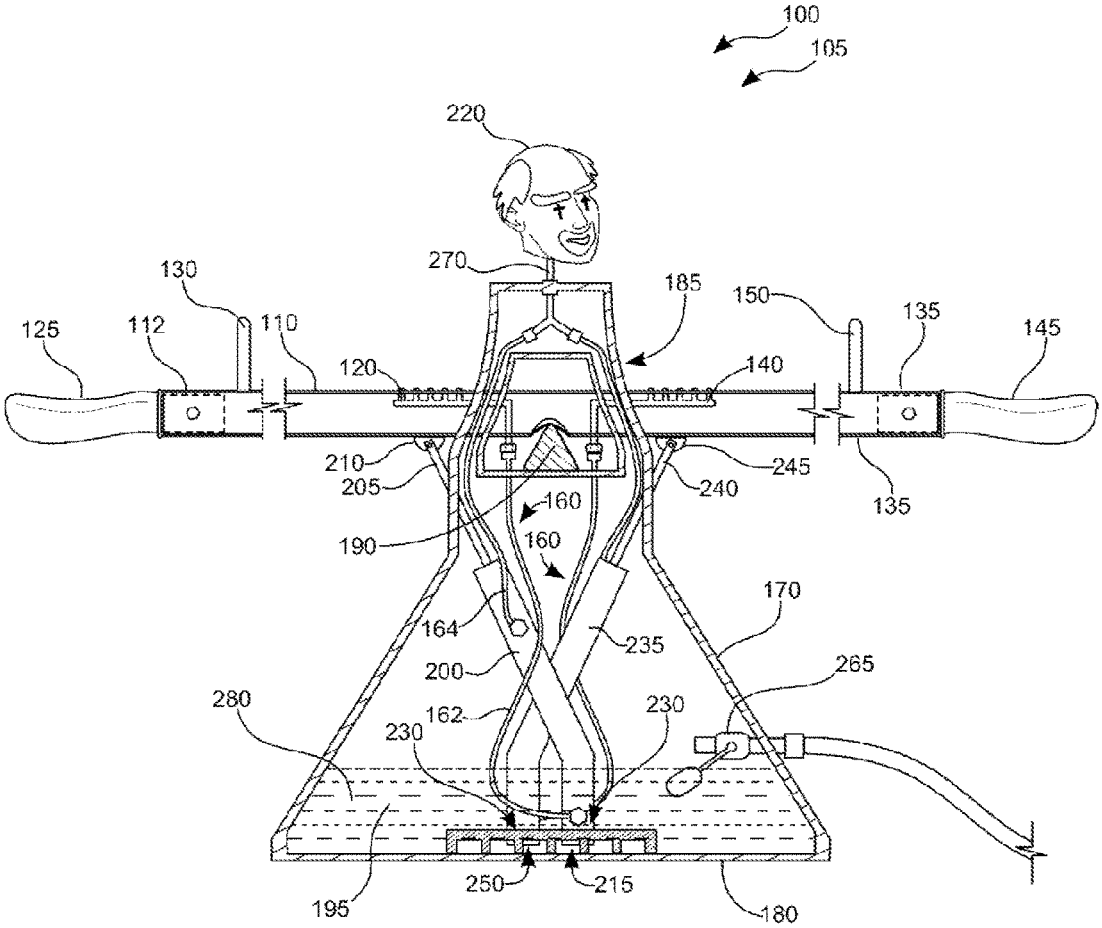
FIG. 3 is a see-through side elevation view illustrating the water teeter-totter system according to an embodiment of the present invention of FIG. 1.

Referring now to FIG. 3, a see-through side elevation view illustrating water teeter-totter system 100 according to an embodiment of the present invention of FIG. 1.

The plurality of first spray nozzles 120 is located linearly along top side 112 of lever 110 toward first end 115 of lever 110 from balance point 155. The plurality of second spray nozzles 140 is located linearly along top side 112 of lever 110 toward second end 135 of lever 110 from balance point 155. First spray nozzles 120 are arranged to spray toward first seat 125 and second spray nozzles 140 are arranged to spray toward second seat 145. First spray nozzles 120 are operatively attached to first piston water pump 200 via a plurality of water tubes 160 so that when first piston water pump 200 is activated, water 280 is sprayed out of first spray nozzles 120. Second spray nozzles 140 are operatively attached to second piston water pump 235 via a plurality of water tubes 160 so that when second piston water pump 235 is activated, water 280 is sprayed out of second spray nozzles 140. Single piston versions may be available.

First piston water pump 200 and second piston water pump 235 are located within water reservoir 195. Water reservoir 195 may comprise hose connection 199 so that it is able to be coupled to a garden hose for filling, and may have float-valve 265 so that when a predetermined high water level within water reservoir 195 is reached, float-valve 265 is able to shut off water 280 to prevent overfilling. First piston water pump 200 and second piston water pump 235 may each comprise intake check valve 230 that allows water 280 to enter first piston water pump 200 and second piston water pump 235 through first intake 215 and second intake 250 respectively and prevents water 280 from exiting again through the same entry point.

A relatively large through-hole 185 is located near top end 175 of base 170 with fulcrum 190 located within through-hole 185 such that lever 110 is able to be positioned through through-hole 185 and pivotally positioned upon fulcrum 190. Lever 110 is operatively attached to first piston water pump 200 and second piston water pump 235. A downward rotation of first end 115 of lever 110 activates first piston water pump 200 and is able to cause water 280 to spray through first spray nozzles 120. A downward rotation of second end 135 of lever 110 activates second piston water pump 235 and is able to cause water 280 to spray through second spray nozzles 140. First piston shaft 205 of first piston water pump 200 is rotatably attached to first piston pivot-bracket 210 that is non-removably attached to bottom side 113 of lever 110 slightly toward first end 115 of lever 110 from fulcrum 190. Second piston shaft 240 of second piston water pump 235 is rotatably attached to second piston pivot-bracket 245 that is non-removably attached to bottom side 113 of lever 110 slightly toward second end 135 of lever 110 from fulcrum 190.

Figure 4:
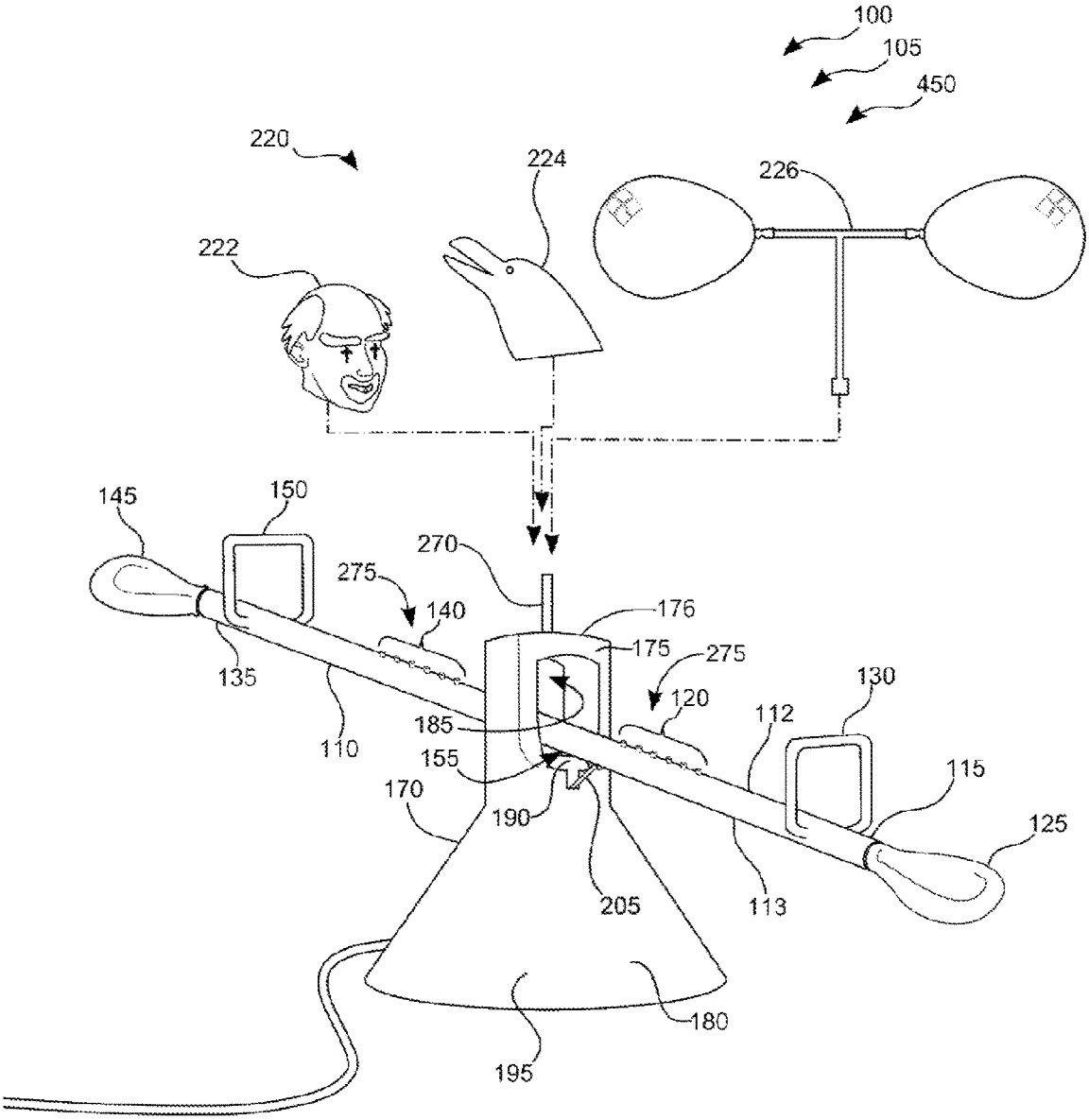
FIG. 4 is a perspective view illustrating an accessory water spout with various appurtenances for the water teeter-totter system according to an embodiment of the present invention of FIG. 1.

Referring now to FIG. 4, a perspective view illustrating accessory water spout 270 with various appurtenances 220 for water teeter-totter system 100 according to an embodiment of the present invention of FIG. 1.

Accessory water spout 270 is located on upper periphery 176 of top end 175 of base 170 and is in operative communication with first 200 and second piston water pump 235 via the plurality of water tubes 160. First piston water pump 200 is able to couple to first water tube 162 and second water tube 164. First water tube 162 is coupleable to first spray nozzles 120 and second water tube 164 is coupleable to accessory water spout 270. At least one appurtenance 220 is coupleable to accessory water spout 270 such that appurtenance 220 is able to spray water 280 via first piston water pump 200 and second piston water pump 235. Appurtenances 220 may have the appearance of a simulated clown head 222, dolphin head 224, or balloon holder 226 that may be able to couple to more than one balloon simultaneously. First piston water pump 200 and second piston water pump 235 are each able to pump air instead of water 280 through accessory water spout 270 to fill at least one balloon via balloon holder 226 if the user so desires.

Water teeter-totter system 100 may be sold as kit 450 comprising the following parts: at least one lever 110 having a plurality of first spray nozzles 120 and a plurality of second spray nozzles 140; at least one first seat 125 and second seat 145; at least one first handle 130 and second handle 150; at least one base 170 having at least one first piston water pump 200 and at least one second piston water pump 235; a plurality of water tubes 160; at least one accessory water spout 270; at least one appurtenance 220; and at least one set of user instructions. The kit has instructions such that functional relationships are detailed in relation to the structure of the invention (such that the invention can be used, maintained, or the like in a preferred manner). Water teeter-totter systems 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different water moving means, parts may be sold separately, etc., may be sufficient.

Figure 5:
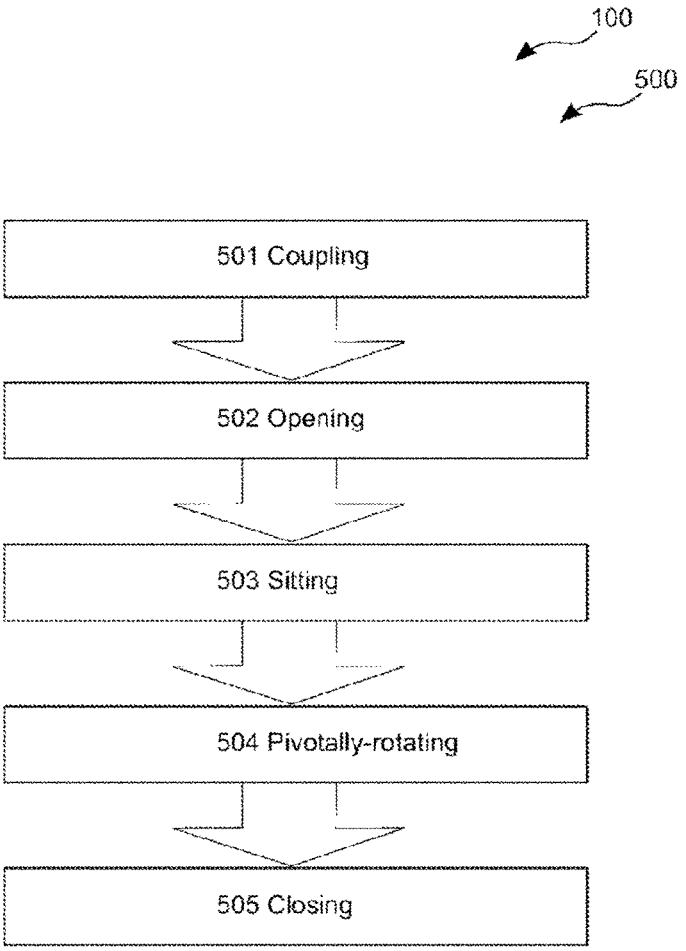
FIG. 5 is a flowchart illustrating a method of use for the water teeter-totter system according to an embodiment of the present invention of FIGS. 1-4.

Referring now to FIG. 5, showing method of use 500 for water teeter-totter systems 100. A method 500 of using water teeter-totter systems 100 may comprise the steps of step one 501 coupling a garden hose to hose connection 199 on water reservoir 195 of teeter-totter assembly 105; step two 502 opening hose connection 199 to fill water reservoir 195; step three 503 sitting on first seat 125 and second seat 145 simultaneously by first 285 and second user 290; step four 504 pivotally-rotating lever 110 so that first seat 125 and second seat 145 rises and falls oppositely from each other causing water 280 to spray alternately toward first seat 125 and second seat 145; and step five 505 closing the hose bib and disconnecting water 280.

It should be noted that steps 501-502 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A water teeter-totter system comprising:
a teeter-totter assembly comprising;
a lever having;
a first end having;
a plurality of first spray nozzles;
a first seat; and
a first handle;
a second end having;
a plurality of second spray nozzles;
a second seat; and
a second handle;
a balance point;
a base comprising;
a top end; and
a bottom end;
a through-hole having;
a fulcrum;
a water reservoir;
a first piston water pump and a second piston water pump;
a plurality of water tubes; and
at least one accessory water spout;
wherein said water teeter-totter system comprises said teeter-totter assembly, said teeter-totter assembly designed for entertaining children;
wherein said first end of said lever is at an opposing end of said lever from said second end;
wherein said first seat is attached to said first end of said lever and said second seat is attached to said second end of said lever;
wherein said first handle is rigidly attached to a top side of said lever near said first seat and said second handle is rigidly attached to a top side of said lever near said second seat;
wherein said balance point is located on a bottom side of said lever midway between said first end and said second end;
wherein said plurality of first spray nozzles are located linearly along said top side of said lever toward said first end of said lever from said balance point;
wherein said plurality of second spray nozzles are located linearly along said top side of said lever toward said second end of said lever from said balance point;
wherein said plurality of first spray nozzles are operatively attached to said first piston water pump via said plurality of water tubes such that an activation of said first piston water pump is structured and arranged to function to spray water out of said plurality of first spray nozzles;
wherein said plurality of second spray nozzles are operatively attached to said second piston water pump via said plurality of water tubes such that an activation of said second piston water pump is structured and arranged to function to spray said water out of said plurality of second spray nozzles;
wherein said base comprises said top end vertically and concentrically above said bottom end, said bottom end larger in diameter than said top end;
wherein said water reservoir is located within said bottom end of said base;
wherein said first piston water pump and said second piston water pump are located within said water reservoir;
wherein said through-hole is located near said top end of said base and said fulcrum is located within said through-hole such that said lever is able to be positioned through said through-hole and pivotally positioned upon said fulcrum;
wherein said lever is operatively attached to said first piston water pump and said second piston water pump;
wherein said at least one accessory water spout is located on an upper periphery of said top end of said base and is in operative communication with said first piston water pump and said second piston water pump via said plurality of water tubes; and
wherein said teeter-totter assembly is useful for filling said water reservoir of said base with said water and wherein a continuous up and down pivoting motion of said lever via a first user sitting on said first seat and a second user sitting on said second seat, activates said first piston water pump and said second piston water pump to pump water through said plurality of first spray nozzles and said plurality of second spray nozzles to spray said first user and said second user for amusement.

2. The water teeter-totter system of claim 1 wherein a first piston shaft of said first piston water pump is attached to a first piston pivot-bracket that is non-removably attached to said bottom side of said lever slightly toward said first end of said lever from said fulcrum.

3. The water teeter-totter system of claim 1 wherein a second piston shaft of said second piston water pump is attached to a second piston pivot-bracket that is non-removably attached to said bottom side of said lever slightly toward said second end of said lever from said fulcrum.

4. The water teeter-totter system of claim 1 wherein said first piston water pump and said second piston water pump each comprise an intake check valve that allows said water to enter said first piston water pump and said second piston water pump through a first intake and a second intake respectively and not exit again therethrough.

5. The water teeter-totter system of claim 1 wherein said reservoir comprises a hose connection such that said reservoir is able to be coupled to a garden hose and filled with said water via said garden hose.

6. The water teeter-totter system of claim 5 wherein said reservoir comprises a float-valve such that when a high-water level within said reservoir is reached, said float-valve is able to shut off said water to prevent an overfilling.

7. The water teeter-totter system of claim 1 wherein at least one appurtenance is coupleable to said at least one accessory water spout such that said at least one appurtenance is able to spray said water via said first piston water pump and said second piston water pump.

8. The water teeter-totter system of claim 7 wherein said at least one appurtenance comprises a simulated clown head.

9. The water teeter-totter system of claim 7 wherein said at least one appurtenance comprises a dolphin head.

10. The water teeter-totter system of claim 7 wherein said at least one appurtenance comprises a balloon holder.

11. The water teeter-totter system of claim 10 wherein said first piston water pump and said second piston water pump are each able to pump air through said at least one accessory water spout to fill at least one balloon via said balloon holder.

12. The water teeter-totter system of claim 1 wherein said first piston water pump is able to couple to a first water tube and a second water tube, said first water tube coupleable to said plurality of first water spray nozzles and said second water tube coupleable to said at least one accessory water spout.

13. The water teeter-totter system of claim 1 wherein said plurality of first spray nozzles are able to spray toward said first seat and said plurality of second spray nozzles are able to spray toward said second seat.

14. The water teeter-totter system of claim 1 wherein said balloon holder is able to couple to a plurality of balloons.

15. The water teeter-totter system of claim 1 wherein said downward rotation of said first end of said lever activates said first piston water pump and is able to cause said water to spray through said plurality of first spray nozzles.

16. The water teeter-totter system of claim 1 wherein said downward rotation of said second end of said lever activates said second piston water pump and is able to cause said water to spray through said plurality of second spray nozzles.

17. The water teeter-totter system of claim 1 wherein said reservoir comprises an inverted frustoconical profile having a larger diameter bottom end designed for contacting a ground surface, said base able to stabilize said teeter-totter assembly when said reservoir is filled with said water.

18. A water teeter-totter system comprising:

a teeter-totter assembly comprising;
- a lever having;
  - a first end having;
    - a plurality of first spray nozzles;
    - a first seat; and
    - a first handle;
  - a second end having;
    - a plurality of second spray nozzles;
    - a second seat; and
    - a second handle;
  - a balance point;
- a base comprising;
  - a top end; and
  - a bottom end;
  - a through-hole having;
    - a fulcrum;
    - a water reservoir;
  - a first piston water pump and a second piston water pump;
  - a plurality of water tubes; and
  - at least one accessory water spout;

wherein said water teeter-totter system comprises said teeter-totter assembly, said teeter-totter assembly designed for entertaining children;

wherein said first end of said lever is at an opposing end of said lever from said second end;

wherein said first seat is attached to said first end of said lever and said second seat is attached to said second end of said lever;

wherein said first handle is rigidly attached to a top side of said lever near said first seat and said second handle is rigidly attached to a top side of said lever near said second seat;

wherein said balance point is located on a bottom side of said lever midway between said first end and said second end;

wherein said plurality of first spray nozzles are located linearly along said top side of said lever toward said first end of said lever from said balance point;

wherein said plurality of second spray nozzles are located linearly along said top side of said lever toward said second end of said lever from said balance point;

wherein said plurality of first spray nozzles are able to spray toward said first seat and said plurality of second spray nozzles are able to spray toward said second seat;

wherein said plurality of first spray nozzles are operatively attached to said first piston water pump via said plurality of water tubes such that an activation of said first piston water pump is structured and arranged to function to spray water out of said plurality of first spray nozzles;

wherein said plurality of second spray nozzles are operatively attached to said second piston water pump via said plurality of water tubes such that an activation of said second piston water pump is structured and arranged to function to spray said water out of said plurality of second spray nozzles;

wherein said base comprises said top end vertically and concentrically above said bottom end, said bottom end larger in diameter than said top end;

wherein said water reservoir is located within said bottom end of said base;

wherein said first piston water pump and said second piston water pump are located within said water reservoir;

wherein said reservoir comprises an inverted frustoconical profile having a larger diameter bottom end designed for contacting a ground surface, said base able to stabilize said teeter-totter assembly when said reservoir is filled with said water;

wherein said reservoir comprises a hose connection such that said reservoir is able to be coupled to a garden hose and filled with said water via said garden hose;

wherein said reservoir comprises a float-valve such that when a high-water level within said reservoir is reached, said float-valve is able to shut off said water to prevent an overfilling;

wherein said first piston water pump and said second piston water pump each comprise an intake check valve that allows said water to enter said first piston water pump and said second piston water pump through a first intake and a second intake respectively and not exit again therethrough;

wherein said through-hole is located near said top end of said base and said fulcrum is located within said through-hole such that said lever is able to be positioned through said through-hole and pivotally positioned upon said fulcrum;

wherein said lever is operatively attached to said first piston water pump and said second piston water pump;

wherein said downward rotation of said first end of said lever activates said first piston water pump and is able to cause said water to spray through said plurality of first spray nozzles;

wherein said downward rotation of said second end of said lever activates said second piston water pump and is able to cause said water to spray through said plurality of second spray nozzles;

wherein a first piston shaft of said first piston water pump is attached to a first piston pivot-bracket that is non-removably attached to said bottom side of said lever slightly toward said first end of said lever from said fulcrum;

wherein a second piston shaft of said second piston water pump is attached to a second piston pivot-bracket that is non-removably attached to said bottom side of said lever slightly toward said second end of said lever from said fulcrum;

wherein said at least one accessory water spout is located on an upper periphery of said top end of said base and is in operative communication with said first piston water pump and said second piston water pump via said plurality of water tubes;

wherein said first piston water pump is able to couple to a first water tube and a second water tube, said first water tube coupleable to said plurality of first water spray nozzles and said second water tube coupleable to said at least one accessory water spout;

wherein at least one appurtenance is coupleable to said at least one accessory water spout such that said at least one appurtenance is able to spray said water via said first piston water pump and said second piston water pump;

wherein said at least one appurtenance comprises a simulated clown head;

wherein said at least one appurtenance comprises a dolphin head;

wherein said at least one appurtenance comprises a balloon holder;

wherein said balloon holder is able to couple to a plurality of balloons;

wherein said first piston water pump and said second piston water pump are each able to pump air through said at least one accessory water spout to fill at least one balloon via said balloon holder; and wherein said teeter-totter assembly is useful for filling said water reservoir of said base with said water and wherein a continuous up and down pivoting motion of said lever via a first user sitting on said first seat and a second user sitting on said second seat, activates said first piston water pump and said second piston water pump to pump water through said plurality of first spray nozzles and said plurality of second spray nozzles to spray said first user and said second user for amusement.

19. The water teeter-totter system of claim 18 further comprising a kit including:

said at least one teeter-totter assembly having;

said at least one lever having said plurality of first spray nozzles, said plurality of second spray nozzles, said first seat, said second seat, said first handle, and said second handle;

said at least one base having said at least one first piston water pump and said at least one second piston water pump;

said at least one plurality of water tubes;

said at least one accessory water spout;

said at least one appurtenance; and at least one set of user instructions.

* * * * *